US007806191B2

(12) United States Patent
Braden et al.

(10) Patent No.: US 7,806,191 B2
(45) Date of Patent: Oct. 5, 2010

(54) COMMUNICATION CONNECTIONS FOR WIRED DRILL PIPE JOINTS FOR PROVIDING MULTIPLE COMMUNICATION PATHS

(75) Inventors: Jason Braden, Pearland, TX (US); Jean-Charles Rinaldi, Cannes (FR); Michael A. Montgomery, Sugar Land, TX (US)

(73) Assignee: IntelliServ, LLC, Houston, TX (US)

( * ) Notice: Subject to any disclaimer, the term of this patent is extended or adjusted under 35 U.S.C. 154(b) by 18 days.

(21) Appl. No.: 11/965,440

(22) Filed: Dec. 27, 2007

(65) Prior Publication Data

US 2009/0166087 A1 Jul. 2, 2009

(51) Int. Cl.
*E21B 47/16* (2006.01)

(52) U.S. Cl. ..... 166/380; 166/242.6; 175/40; 439/194

(58) Field of Classification Search ..... 166/380, 166/242.6; 175/40, 320; 439/194, 578
See application file for complete search history.

(56) References Cited

U.S. PATENT DOCUMENTS

| | | | | |
|---|---|---|---|---|
| 3,518,608 | A * | 6/1970 | Papadopoulos | 439/191 |
| 3,518,609 | A * | 6/1970 | Fontenot, Jr. | 439/191 |
| 6,123,561 | A | 9/2000 | Turner et al. | |
| 6,845,822 | B2 * | 1/2005 | Chau | 166/380 |
| 7,114,970 | B2 | 10/2006 | Head | |
| 2005/0098356 | A1 * | 5/2005 | Chau | 175/321 |
| 2006/0124291 | A1 * | 6/2006 | Chau | 166/65.1 |
| 2006/0225926 | A1 | 10/2006 | Madhavan et al. | |
| 2006/0260797 | A1 | 11/2006 | Hall et al. | |

* cited by examiner

*Primary Examiner*—Shane Bomar
(74) *Attorney, Agent, or Firm*—Conley Rose, P.C.

(57) ABSTRACT

A drill pipe includes a pin end connector, a box end connector, a first communication connector having a plurality of first communication contacts and a second communication connector having a plurality of second communication contacts. The pin end connector is received by the box end connector to join sections of a drill pipe together. When the drill pipe sections are joined by the pin end and box end connectors, a plurality of isolated communication connections is formed between the first communication contacts and the second communication contacts.

19 Claims, 5 Drawing Sheets

COMMUNICATION CONNECTIONS FOR WIRED DRILL PIPE JOINTS FOR PROVIDING MULTIPLE COMMUNICATION PATHS

BACKGROUND

The invention generally relates to communication connections for wired drill pipe joints.

A typical system for drilling an oil or gas well includes a tubular drill pipe, also called a "drill string," and a drill bit that is located at the lower end of the pipe. During drilling, the drill bit is rotated to remove formation rock, and a drilling fluid called "mud" is circulated through the drill pipe and returns up the annul us for such purposes as removing thermal energy from the drill bit and removing debris that is generated by the drilling. A surface pumping system typically generates the circulating mud flow by delivering the mud to the central passageway of the drill pipe and receiving mud from the annulus of the well. More specifically, the circulating mud flow typically propagates downhole through the central passageway of the drill pipe, exits the drill pipe at nozzles that are located near the drill bit and returns to the surface pumping system via the annulus.

One technique to rotate the drill bit involves applying a rotational force (through a rotary table and kelly arrangement or through a motorized swivel, as examples) to the drill pipe at the surface of the well to rotate the drill bit at the bottom of the string. Another conventional technique to rotate the drill bit takes advantage of the mud flow through the drill pipe by using the flow to drive a downhole mud motor, which is located near the drill bit. The mud motor responds to the mud flow to produce a rotational force that turns the drill bit.

The drilling of the well may be aided by communication between the surface of the well and tools at the bottom of the drill pipe. In this regard, the bottom end of a conventional drill pipe may include tools that measure various downhole parameters (pressures, temperatures and formation parameters, as examples) and characteristics of the drilling (orientation of the drill hit, for example), which are communicated uphole. The uphole communication from a downhole location to the surface may involve the use of a mud pulse telemetry tool to modulate the circulating mud flow so that at the surface of the well, the modulated mud flow may be decoded to extract data relating to downhole measurements. Additionally, downhole communication may be established from the surface of the well to downhole tools of the drill pipe through one of a number of different conventional telemetry techniques. This downhole communication may involve, as examples, acoustic or electromagnetic signaling.

A more recent innovation in drill pipe telemetry involves the use of a wired drill pipe (WDP) infrastructure, such as the WDP infrastructure that is described in U.S. Patent Application Publication No. US 2006/0225926 A1, entitled, "METHOD AND CONDUIT FOR TRANSMITTING SIGNALS," which published on Oct. 12, 2006 and is owned by the same assignee as the present application. The WDP infrastructure typically includes communication lines that are embedded in the housing of the drill pipe. Because a conventional drill pipe may be formed from jointed tubing sections, communication connections for the WDP infrastructure may be made at each joint of the drill string. Although any one communication connection may be used for bidirectional communications, providing separate communication connections dedicated to either uphole or downhole communications may facilitate the transmission of information. Furthermore, multiple connections used for communication in a given direction may provide additional advantages such as transmitting in a differential mode, which can allow rejection of common mode noise, and balanced transmission. Or the multiple connections can provide additional communication channels in either direction. In addition, in some applications, power signals are communicated to the downhole fool in addition to data and/or control signals. In such an application, it would be desirable to employ a separate communication path for the power signals such that noise generated on the power communication path does not interfere with data and control signals.

SUMMARY

According to a first aspect of the invention, a drill pipe comprises a pin end connector having a communication contact region having first, second and third communication contacts; and a box end connector to receive the pin end connector to form a connection between drill pipe sections. The box end connector comprises a complementary contact region having first, second and third complementary communication contacts. When the drill pipe sections are connection, first, second and third isolated communication connections are formed between the complementary communication contacts and the communication contacts.

According to another aspect of the invention, a drill pipe assembly useable in a wellbore comprises a controller located at a surface of the wellbore and a drill pip disposed in the wellbore. The drill pipe comprises first, second and third communication paths coupled to the controller, wherein the communication paths are isolated from one another. The drill pipe further comprises a pin end connector and a box end connector to receive the pin end connector to connect sections of the drill pipe. The drill pipe also comprises a first communication connector having a plurality of first contacts, and a second communication connector having a plurality of second contacts. When the drill pipe sections are connected by the box end and pin end connectors, the first contacts couple with the second contacts and the first, second and third communication paths span between the drill pipe sections.

According to yet another aspect of the invention, a method comprises connecting drill pipe sections together comprising receiving a pin end connector with a box end connector. The pin end connector comprises a communication contact region having first, second and third communication contacts. The box end connector comprises a complementary communication contact region having first, second and third complementary contacts. The method further comprises communicating signals using first, second and third isolated communication paths formed between the communication contact region and the complementary communication contact region.

Advantages and other features of the invention will become apparent from the following drawing, description and claims.

DETAILED DESCRIPTION

Figure 1:
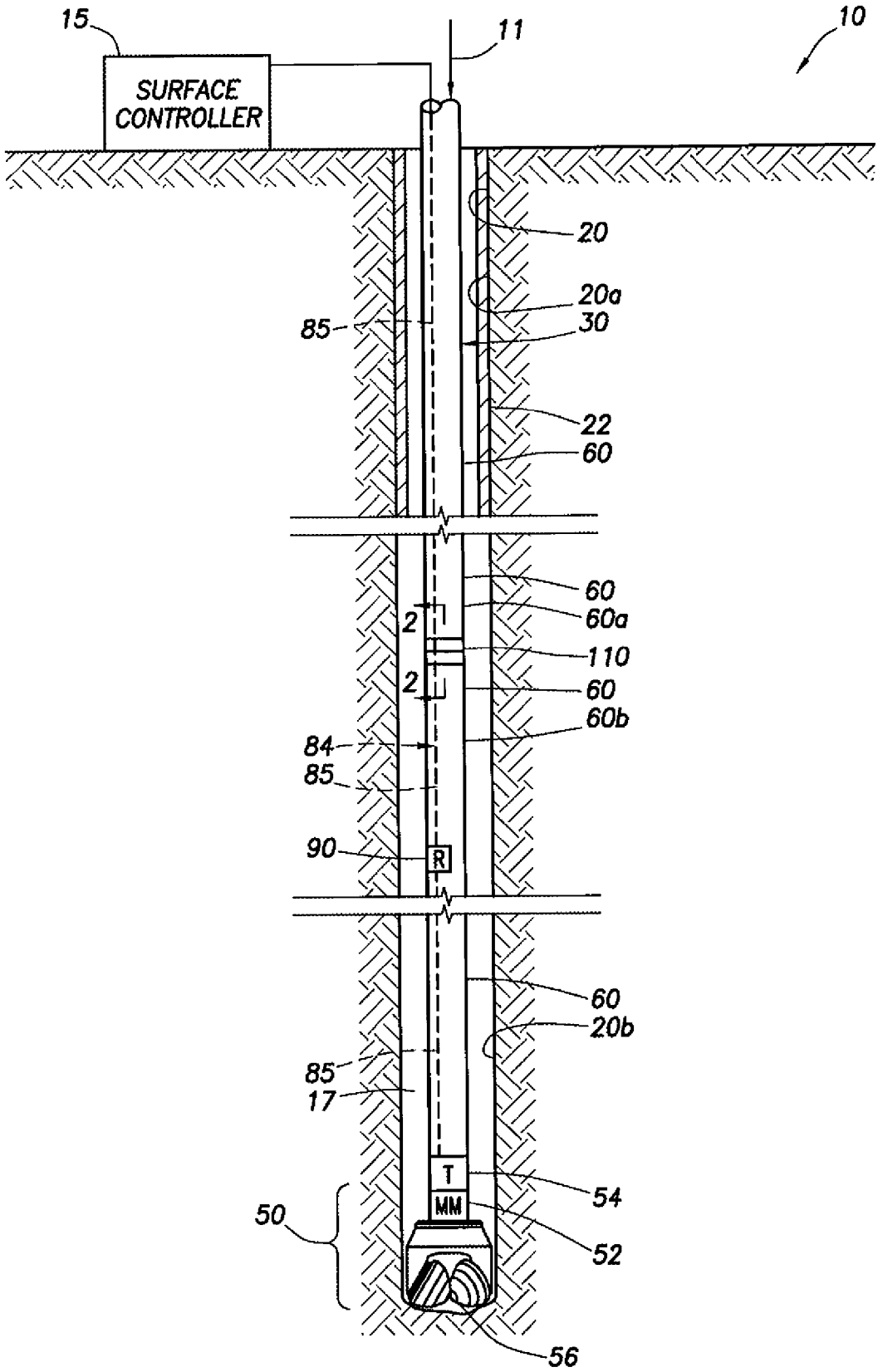
FIG. 1 is a schematic diagram of a drilling system according to an example.

According to one example, FIG. 1 schematically depicts a drilling system 10 that includes a drill string, or pipe 30. During drilling of a wellbore 20, a surface pumping system (not shown) delivers a mud flow 11 to the central passageway of the drill pipe 30, and the mud flow 11 propagates downhole through the pipe 30. Near the bottom end of the drill pipe 30, the mud flow 11 exits the pipe 30 at nozzles (not shown) and returns uphole to the surface pumping system via an annul us 17 of the well. As an example, the circulating mud flow may actuate a downhole mud motor 52 that, in turn, rotates a drill bit 56 of the drill pipe 30.

FIG. 1 depicts a particular stage of the well during its drilling and completion. In this stage, an upper segment 20*a* of the wellbore 20 has been formed through the operation of the drill pipe 30, and the wellbore segment 20*a* is lined with and supported by a casing string 22 that has been installed in the segment 20*a*. For this example, the wellbore 20 extends below the cased segment 20*a* into a lower, uncased segment 20*b*.

Thus, for the example that is depicted in FIG. 1, drilling operations may be interlaced with casing installation operations. However, the drill pipe 30 may alternatively he used as part of the well completion, in another example. In this manner, the drill pipe 30 may be constructed to line and support the wellbore 20 so that at the conclusion of the drilling operation, the drill pipe 30 is left in the well to perform the traditional function of the casing.

The drilling operation and/or the downhole formations through which the wellbore 20 extends may be monitored at the surface of the well via measurements that are acquired downhole. For this purpose, the drill pipe 30 has a wired drill pipe (WDP) infrastructure 84 for purposes of establishing multiple communication paths between the surface of the well and downhole tools that, acquire the measurements, such as tools that are part of a bottom hole assembly (BHA) 50 of the pipe 30. As non-limiting examples, the WDP infrastructure 84 may provide electrical and/or optical communication paths.

The communication through the WDP infrastructure 84 may be bidirectional, in that the communication may be from the surface of the well to the BHA 50 and/or from the BHA 50 to the surface of the well. Furthermore, the communication may involve the communication of power from the surface of the well to the BHA 50 and may involve the communication of data signals between the BHA 50 and the surface of the well. Thus, many variations and uses of the WDP infrastructure 84 are contemplated and are within the scope of the appended claims.

The WDP infrastructure 84 includes communication line segments 85 (fiber optic line segments or electrical cable segments, as just a few examples) that are embedded in the housing of the drill pipe 30, and the WDP infrastructure 84 may include various repeaters 90 (one repeater 90 being depicted in FIG. 1) along the drill pipe's length to boost the communicated signals.

In general, the drill pipe 30 is formed from jointed tubing sections 60 (specific jointed tubing sections 60*a* and 60*b* being labeled in FIG. 1 and described herein as examples) that are joined together at WDP joints 110 (one WDP joint 110 between the jointed tubing sections 60*a* and 60*b* being depicted in FIG. 1 as an example). As an example, each WDP joint 110 may be part of a drill pipe connection sub.

A given jointed tubing section 60 may have one or more communication line segments 85, possibly one or more repeaters 90 and communication connectors (not shown in FIG. 1) on either end of each communication line segment 85. As described below, the communication connectors are disposed in the WDP joints 110 for purposes of connecting the communication line segments 85 of different jointed tubing sections 60 together. Pursuant to the WDP infrastructure, the drill pipe 30 may contain multiple communication paths that extend between the surface and downhole, with each communication path being formed from serially connected communication line segments 85, repeaters 90 and WDP joint communication connectors.

Among the other features of the drill pipe 30, the BHA 50 may include a tool 54 that communicates with a surface controller 15 via signals that are communicated over the WDP infrastructure 84. As examples, the tool 54 may receive power, control and/or data signals from the WDP infrastructure 84. Furthermore, the tool 54 may transmit, signals (signals indicative of acquired measurements, for example) uphole to the surface controller 15 via the WDP infrastructure 84.

The tool 54 may be constructed to acquire downhole measurements, and in addition to using the WDP infrastructure 84, the tool 54 may use alternative paths (such as mud pulse telemetry, for example) for communicating with the surface. As non-limiting examples, the tool 54 may be a measurement while drilling (MWD) tool, a logging while drilling (LWD) tool, a formation tester, an acoustic-based imager, a resistivity tool, etc. Furthermore, the drill pipe 30 may contain a plurality of such tools that communicate with the surface via the WDP infrastructure 84. It is noted that the drill pipe 30 may include various other features, such as a drill collars, an under-reamer, etc., as the depiction of the drill pipe 30 in FIG. 1 is simplified for purposes of illustrating certain aspects of the pipe 30 related to the WDP infrastructure 84 and the WDP joints 110.

It is noted that the WDP infrastructure 84 may be used for purposes of performing tests in the well, such as a leak off test, as described in co-pending U.S. patent application Ser. No. 11/876,914, entitled, "TECHNIQUE AND APPARATUS TO PERFORM A LEAK OFF TEST IN A WELL," filed on Oct. 23, 2007, which is owned by the same assignee as the present application. Additionally, the WDP infrastructure 84 may he used for purposes of monitoring a plug cementing operation, as described in co-pending U.S. patent application Ser. No. 11/951,471, entitled, "TECHNIQUE AND APPARATUS TO DEPLOY A CEMENT PLUG IN A WELL," which is owned by the same assignee as the present application.

Figure 2:
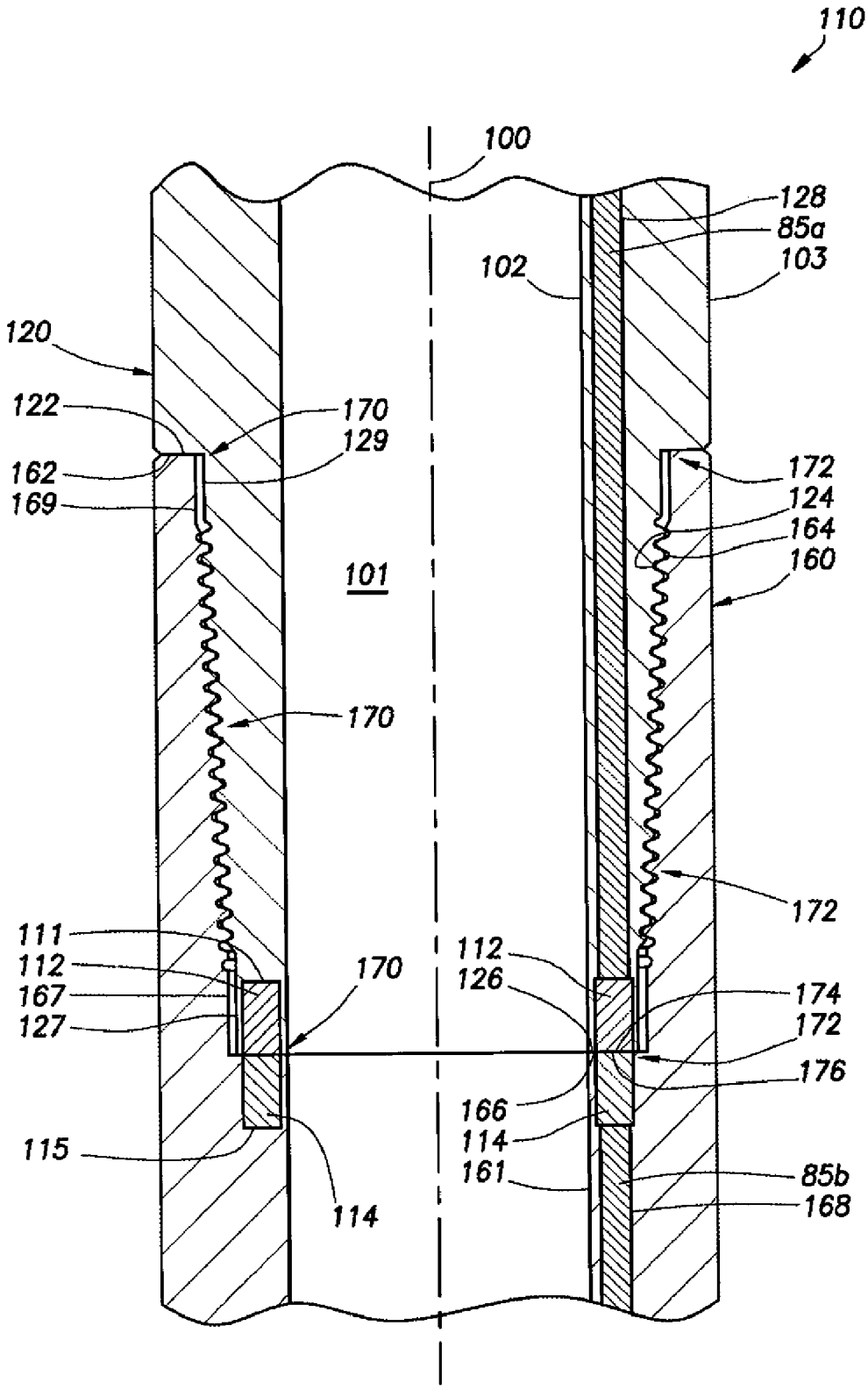
FIG. 2 is a cross-sectional view of a wired drill pipe joint taken along line 2-2 of FIG. 1 according to an example.

FIG. 2 depicts a cross-sectional view of the WDP joint 110 when fully assembled. Referring to FIG. 2 in conjunction with FIG. 1, in general, the WDP joint 110 includes two main components for purposes of mechanically connecting the upper jointed tubing section 60*a* to the lower jointed tubing section 60*b*: a pin end connector 120 and a box end connector 160. Before the pin end 120 and box end 160 connectors are mated together, the pin end connector 120 is secured to (threaded to, for example) the lower end of the upper jointed tubing section 60*a*, and the box end connector 160 is secured to (threaded to, for example) the upper end of the lower jointed tubing section 60*b,* in connections that are not depicted. In general, the pin end 120 and box end 160 connectors are concentric about a longitudinal axis 100, which is coaxial with the drill pipe 30 near the WDP joint 110. Additionally, the pin end 120 and box end 160 connectors have respective central passageways that concentrically align to form a corresponding section 101 of a central passageway of the drill pipe 30 when the WDP joint 110 is fully assembled.

As a more specific example, the WDP joint 110 may be a double shoulder, rotary connection, in that the upper jointed tubing section 60*a* and the attached pin end connector 120 are rotated about the longitudinal axis 100 with respect to the box end connector 160 and the attached lower jointed tubing section 60*b* for purposes of threadably connecting the pin end 120 and box end 160 connectors together. In this regard, for this example, the pin end connector 120 has an external tapered thread 124 that helically circumscribes the longitudinal axis 100 and is constructed to engage a mating, internal tapered thread 164 (of the box end connector 160), which also helically circumscribes the longitudinal axis 100.

When the WDP joint 110 is fully assembled, a downwardly directed annular face 126 of the pin end connector 120 contacts or at least comes in close proximity to an upwardly directed face 166 of the inner annular shoulder of the box end connector 160. Also, when the WDP joint 110 is fully assembled, an upwardly directed annular face 162 of the box end connector 160 contacts or at least comes in close proximity to a downwardly directed face 122 of the external annular shoulder of the pin end connector 120.

The external thread 124 of the pin end connector 120 longitudinally and continuously (as one example) extends between two relatively smooth external cylindrical surfaces 127 and 129 of the connector 120. More specifically, the external thread 124 longitudinally extends from the external surface 129 (which is located near the face 122 of the external shoulder) to the external surface 127 (which is located near the lower end of the pin end connector 120). The internal thread 164 of the box end connector 160 longitudinally and continuously (as one example) extends between two relatively smooth internal cylindrical surfaces 167 and 169 of the connector 160. More specifically, the internal thread 164 extends from the internal surface 169, which is located near upper end of the box end connector 160 to the internal surface 167, which is located near the face 166 of the internal shoulder of the box end connector 160.

As depicted in FIG. 2, when the WDP joint 110 is fully assembled, the internal surface 169 of the box end connector 160 is adjacent to and located radially outside of the external surface 129 of the pin end connector 120. Also, for the fully assembled WDP joint 110, the internal surface 167 of the box end connector 160 is adjacent to and located radially outside of the external surface 127 of the pin end connector 120.

In accordance with examples that are described herein, communication connectors are disposed in the pin end 120 and box end 160 connectors for purposes of establishing multiple communication connections (for the WDP infrastructure 84), which span across the WDP joint 110 at a communication contact region 170 of the pin end connector 120 and a complementary communication contact region 172 of the box end connector 160.

Figure 6:
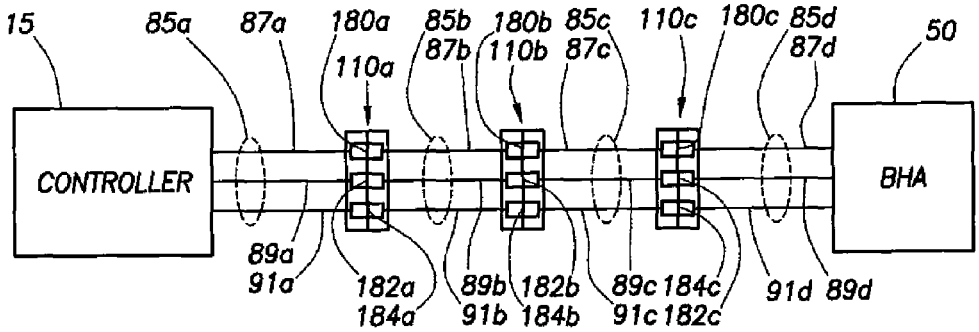
FIG. 6 is a schematic diagram illustrating a plurality of communication path segments connected together at a plurality of wired drill pipe joints, according to an example.
Figure 7:
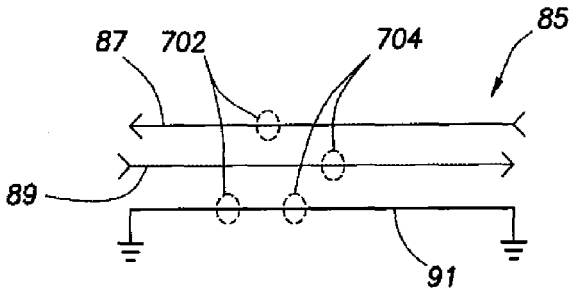
FIG. 7 is a schematic diagram illustrating multiple communication paths that extend along the length of a drill pipe, according to an example.
Figure 8:
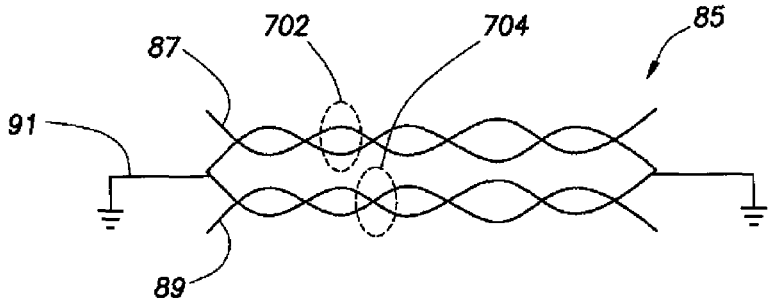
FIG. 8 is a schematic diagram illustrating multiple communication paths that extend along the length of the drill pipe, according to another example.

As a more specific example, FIG. 2 depicts communication connector 112 and complementary communication connector 114, which connect respective communication line segments 85*a* and 85*b* in the jointed tubing sections 60*a* and 60*b* together. For this example, and as depicted in FIGS. 6-8, each communication line segment 85*a-d* includes three or more communication path segments (such as paths 87*a,* 89*a,* 91*a* of segment 85*a*) that are isolated from one another and that, when joined with corresponding communication path segments (e.g., paths 87*b,* 89*b,* 91*b,* respectively), extend across the drill pipe joint 110*a*. For instance, each communication line segment 85*a-d* may be a coaxial style cable with three (or more) communication paths separated in the core. Alternatively, each communication line segment 85*a-d* may be an insulated multi-conductor cable with three (or more) straight signal conductors that, when joined with the conductors in another communication segment, provide communication path 87, 89 and 91. Or, as illustrated in FIG. 8, each communication line segment 85*a-d* may include multiple pairs of twisted conductors to provide communication paths 87, 89 and 91. Depending on the particular application in which the drill pipe assembly is employed, other types of communication line segments also are envisioned, including fiber optic segments having multiple optical signal conductors. However, (with reference to FIG. 6) regardless of the particular configuration of the communication line segments 85*a-d,* when the joints 110*a-c* are fully assembled, a plurality of isolated communication connections 180*a-c,* 182*a-c,* and 184*a-c* result which form a communication line 85 having three (or more) isolated communication paths 87, 89 and 91 which extend along the length of the drill pipe 30 and are coupled on the uphole side to the surface controller 15 and on the downhole side to BHA 50.

Returning now to FIG. 2, in this example, the communication connectors 112 and 114 are arranged to establish the isolated communication connections 180, 182, and 184 such that the connections span between the communication contact regions 170 and 172 at the faces 126 and 166 of the pin end 120 and the box end 160 connectors. More specifically, the communication connector 112 is disposed in a recessed slot 111 formed in the annular face 126 of the longitudinal end of the connector 120 and is generally oriented to form the communication connections 180*a,* 182*a,* 184*a* at the face 126. The complementary communication connector 114 is disposed in a recessed slot 115 formed in the upwardly directed face 166 of the internal shoulder of the box end connector 160. Thus, when the WDP joint 110 is fully assembled, the communication connectors 112 and 114 are in proximity to each other, with a face 174 of the connector 114 facing a face 176 of the connector 112; and in these positions, the connectors 112 and 114 form the isolated communication connections 180*a,* 182*a* and 184*a* that span between the communication contact regions 170 and 172 at the faces 126 and 166 of the pin end 120 and the box end 160 connectors.

As examples, the communication connectors 112 and 114 may be constructed to communicate any of a number of different types of signals across the communication connection, such as electrical signals, optical signals and electromagnetic flux signals, as just a few examples. Thus, the connectors 112 and 114 may be, as examples, direct contact electrical connectors, inductive connectors, resistive couplers, toroid-type connectors, fiber optic connectors, etc. Additionally, the communication connections that are established by the connectors 112 and 114 may be connections to communicate data signals, power signals and/or control signals.

Figure 3:
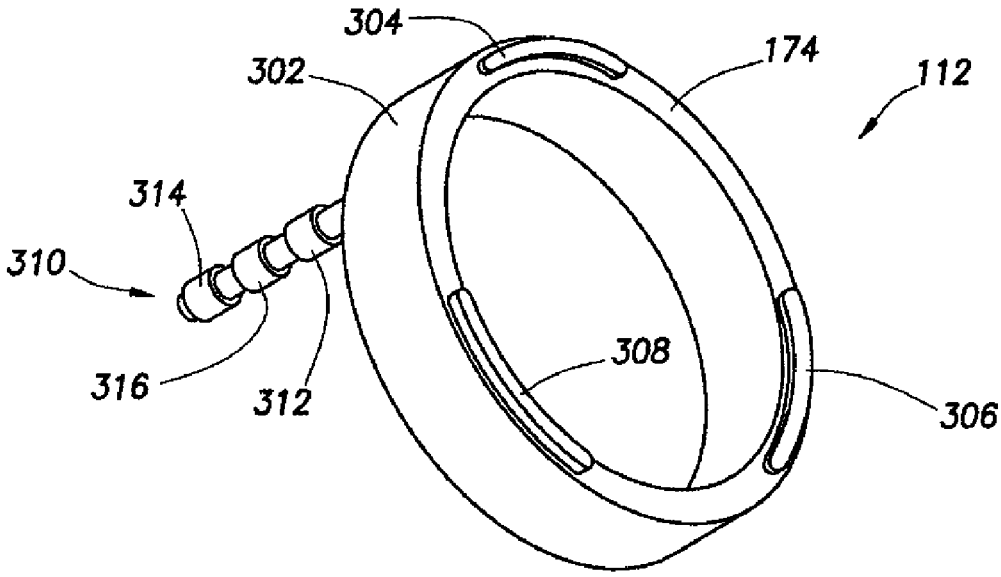
FIG. 3 is a perspective view of a communication connector disposed in the drill pipe joint of FIG. 2, according to an example.

An example of a communication connector 112 is depicted in FIG. 3. In this example, the connector 112 has a toroidal body 302 made of an electrically insulative material. The connector 112 includes first, second and third communication contacts 304, 306, and 308 located on the face 174 of the body 302. In this example, each of the communication contacts 304, 306, and 308 is electrically isolated from the others and from the body 302 of the communication connector 112 and is configured to provide a direct electrical connection to complementary contacts of the complementary communication connector 114 (not shown). Although direct electrical contacts are depicted, it should be understood that the body 302 of the connector 112 may be configured to support a variety of different types of contacts, such as inductive couplers, fiber optic couplers, etc.

Connections between the communication contacts 304, 306, and 308 and the communication path segments 87*a*, 89*a*, and 91*a* of the communication line segment 85*a* may be provided in a variety of different manners, such as by a connecting portion 310 that extends from the toroidal body 302. A plurality of electrically isolated connection points 312, 314, and 316 are provided on the connecting portion 310, each of which is connected to a respective communication contact 304, 306, and 308. The connection between the connection points 312, 314, 316 and the communication contacts 304, 306, 308 may be made in any of a variety of manners, such as by conductive traces (not shown) that extend through the body 302 of the connector 112. The connecting portion 310 may be configured to be received by a complementary connecting portion (not shown) that is coupled to the communication line segment 85*a*, where the signal conductor(s) of each of the communication path segments 87*a*, 89*a*, 91*a* is coupled to a respective connection point 312, 314, 316 through the complementary connecting portion. In other examples, the signal conductors of the communication line segment 85*a* may be directly connected to the connection points 312, 314, 316, such as by soldering. Alternatively, the connecting portion 310 may be omitted and the signal conductors of line segment 85*a* may be directly connected to the communication contacts 304, 306, 308 themselves.

Returning to FIG. 2, the communication line segment 85*a* extends longitudinally upwardly from the communication connector 112 and is routed through a longitudinal passageway 128 that is formed in the pin end connector 120. For this example, the passageway 128 is located near the pin end connector's inner cylindrical surface 102 that forms part of the central passageway section 101 of the drill pipe 30. However, the passageway 128 may be located closer to an outer surface 103 of the pin end connector 120, as another example. As examples, the passageway 128 may be formed by gun drilling, drilling, electrical discharge machining (EDM) or any other material removal process that forms a hole, whether the cross-section of the hole is round or otherwise. As another example, the passageway 128 may be formed using plunge EDM and cut into almost any shape desired for the cross-section of the passageway 128. The cross-section may be, as examples, round or as another example, oval to reduce stress concentrations.

The box end connector 160 includes a longitudinal passageway 168 through which the communication line segment 85*b* is run to form a connection to the communication connector 114. The passageway 168 may be formed by any of the techniques described above and may have one of a variety of different cross-sectional shapes. As shown, the passageway 168 generally extends downhole from the communication connector 114 and may (as an example) be close to the box end connector's 160 inner surface 161 that forms part of the central passageway section 101 of the drill pipe 30.

In the example shown in FIGS. 2 and 3, the communication connectors 112 and 114 are toroidal in shape and the recessed slots 111 and 115 are configured to receive the communication connectors 112 and 114. To ensure that the communication connectors 112 and 114 are appropriately oriented relative to one another (i.e., so that contacts 304, 306, 308 couple with the appropriate complementary contacts of connector 114), the slots 111 and 115 may be keyed with respect to the connectors 112 and 114. For example, the slot 111 may include a groove into which a feature of the connector 112 snaps or slides. Alternatively, the connecting portion 310 of connector 112 may engage with a recess or other feature at the base of the slot 111 to appropriately position connector 112. Slot 115 may include similar alignment features.

Figure 4:
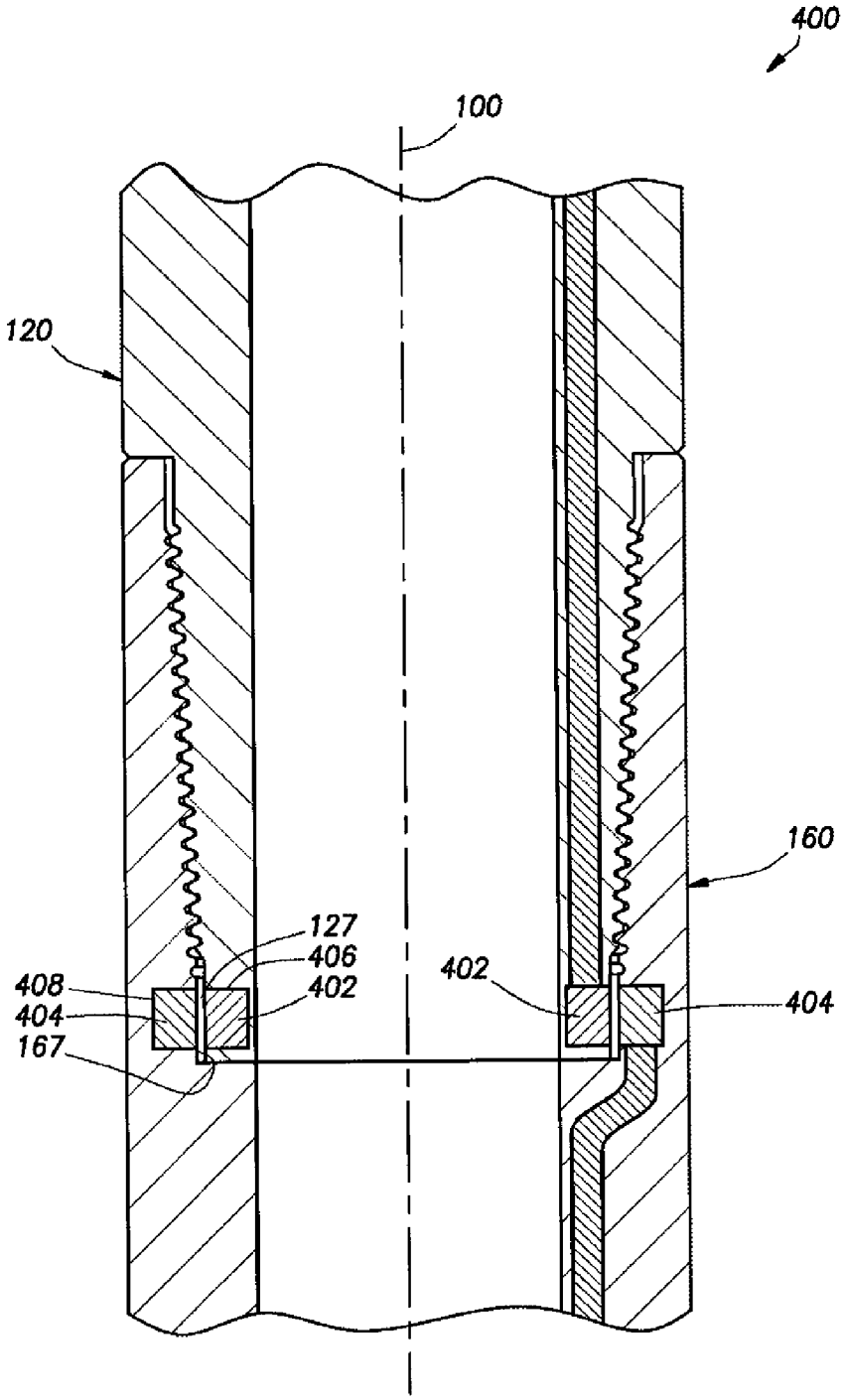
FIG. 4 is a cross-sectional view of another wired drill pipe joint according to another example.

Referring now to FIG. 4, as another example, the WDP joint 110 may be replaced with a WDP joint 400. The WDP joint 400 includes communication connectors 402 and 404 that are disposed in slots 406 (in the pin end connector 120) and 408 (in the box end connector 160), respectively. The slot 406 is formed in the exterior surface 127 of the pin end connector 120 near the longitudinal end and is configured to receive the connector 402, such as the connector 402 shown in FIG. 5. Slot. 408 is formed in the inner surface 167 of the box end connector 160 near the inner shoulder (which is located in the upper end of the box end connector 160) such that when the WDP joint 400 is fully assembled, the connector 404 is positioned radially outwardly from connector 402.

Figure 5:
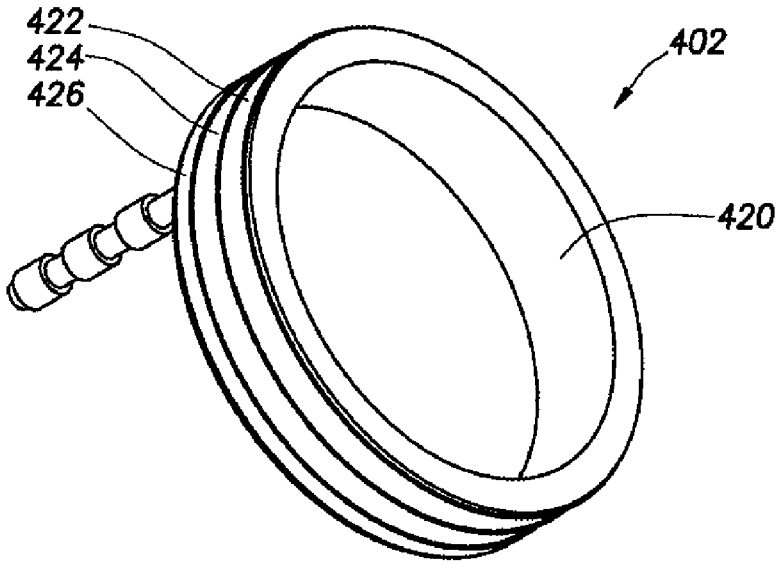
FIG. 5 is a perspective view of a communication connector disposed in the drill pipe joint of FIG. 4, according to an example.

An example of communication connector 402 is depicted in FIG. 5. In this example, connector 402 has a toroidal shaped body 420 made of an insulative material. Three communication contacts 422, 424, 426 (direct electrical contacts, for example) are located on a side surface 428 which extends from a face 430 of the body 420. Each of three communication contacts 422, 424, 426 extend around the circumference of the body 420 and are arranged in parallel spaced apart rows. Although not shown, the complementary communication connector 404 is also toroidal in shape, but has the complementary communication contacts located on the interior side surface, such that when connectors 402 and 404 are coupled, the complementary contacts of connector 404 overlap the contacts 422, 424, 426 of connector 402. To ensure that the communication connections formed between the contacts 422, 424, 426 and the complementary contacts remain isolated from each other, a seal (e.g., a resilient, gasket) may be provided between adjacent contacts 422, 424, 426. It should be understood, however, that other arrangements of contacts 422, 424, 426 on the side surface 428 of connector 402 and other arrangements of complementary contacts on an interior surface of connector 404 also are contemplated. For example, the contacts need not extend around the entire circumference of the body of the connector and they may be arranged in different patterns on the exterior or interior side surfaces. In addition, only two communication contacts may he provided by each connector 402 and 404, or four or more contacts may be provided.

In configurations in which only two communication contacts are provided on each of the communication connectors, a third communication contact (e.g., contact 308, contact 424) and a third complementary communication contact may be provided by drill pipe itself such that the communication connection (e.g., connections 184*a*, 184*b*, 184*c*) is provided by the mechanical connection of the pin end 120 and box end 160 connectors. In such a configuration, the drill pipe connection could form the ground contact for any number of communication paths.

Having established a plurality of communication paths 87, 89, 91 within communication line 85, the communication paths 87, 89, 91 may be configured in a variety of manners to provide for a plurality of communication links between the surface controller 15 and the BHA 50. For instance, as represented in FIGS. 7 and 8, the paths 87, 89 and 91 may be configured as two separate communication links 702 and 704. As shown in FIG. 7, the links 702 and 704 may provide for bi-directional communication between the controller 15 and the BHA 50. A particular advantage of this configuration is to provide for faster and more reliable communications since the link 702 used for uphole communications is separate from the link 704 used for downhole communication.

In one example, the channels 702 and 704 are not completely isolated, and may include crosstalk. Channel separation may vary depending upon may physical factors of the channel, and may be a factor in choosing certain cabling and connection schemes over other schemes. In some examples, the attenuation of the channel may exceed the crosstalk. For example, the channel may have 60 dB of attenuation, while the channel separation may be 40 dB. In this case, the crosstalk from the transmitted signal at the receiver is 20 dB higher than the received signal. Some digital processing techniques may be used to cancel the crosstalk, at the cost of added complexity. But in such cases it may instead be preferable to operate all channels in the same direction, so that the crosstalk suffers the same attenuation as the channel signal, giving the same degree of channel separation at the receive that one had at the transmitter. This may effectivly double or triple the transmission capacity.

The channel direction can be alternated based on various protocols, so that the full capacity of each signal path is available in each direction for specific periods of time. This need not be symmetrical. In most cases, the uplink data requirements are much higher than the downlink requirements. Thus, a protocol may specify the channel remain in the downlink direction only long enough to handle the current downlink traffic, and spend the majority of the time in the uplink direction. Even in cases where crosstalk is not an issue, the need for higher uplink bandwidth may make it undesirable to dedicate a channel to downlink bandwidth. On the other hand, in cases where minimal downlink latency is required, a dedicated downlink channel is ideal.

Alternatively, with reference to FIG. 8, one of the communication paths, such as the path 91, may be configured as a common return that is provided by connecting one conductor of each of a pair of twisted conductors. This configuration may be particularly advantageous to communicate power signals downhole via one of the links 702, 704 and to use the other link 702, 704 to communication data and/or control signals.

The multiple communication paths 87, 89, 91 also provide for redundancy and thus improve the reliability of the drill pipe assembly. For instance, with reference still to FIGS. 6-8, the controller 15 may be configured to select a particular communication link 702 or 704 based on a failure of the other communication link 702 or 704, such as might result from a discontinuity in one of the communication paths 87, 89 or 91. Such redundancy provides for continued operation of the system until a scheduled maintenance is performed, thus reducing the amount of downtime that might otherwise be incurred due to the failure of one of the communication paths.

While the present invention has been described with respect to a limited number of embodiments, those skilled in the art, having the benefit of this disclosure, will appreciate numerous modifications and variations therefrom. It is intended that the appended claims cover all such modifications and variations as fail within the true spirit and scope of this present invention.

What is claimed is:

1. A drill pipe comprising:

a pin end connector comprising a communication contact region having first, second and third communication contacts; and a box end connector to receive the pin end connector to form a connection between drill pipe sections, the box end connector having a body defined between an external surface and an internal surface, the box end connector comprising a complementary contact region having first, second and third complementary communication contacts, such that when the drill pipe sections are connected, first, second, and third isolated communication connections are formed between the complementary communication contacts and the communication contacts, wherein the first, second and third complementary communication contacts are positioned at least partially between the external surface and the internal surface of the box end connector;

wherein the communication contact region comprises a communication connector supported by the pin end connector, the communication connector having an insulative body to support at least the first and second communication contacts;

wherein the first and third communication connections provide for communication in a first direction along the drill pipe, and the second and third communication connections provide for communication in a second direction along the drill pipe opposite the first direction.

2. The drill pipe of claim 1, wherein the communication connector is disposed in a slot formed in a longitudinal, end of the pin end connector such that at least a portion of a face of the insulative body is exposed, and wherein the first and second communication contacts are located on the exposed face.

3. The drill pipe of claim 1, wherein the communication connector is disposed in a slot formed in an exterior circumferential surface of the pin end connector such that at least a portion of a side surface of the insulative body is exposed, and wherein the first and second communication contacts are located on the exposed side surface.

4. The drill pipe of claim 1, wherein the pin end connector comprises a connection region that is received by a complementary connection region of the box end connector to form the connection between the drill pipe sections, and wherein the third communication contact is provided by the connection region and the third complementary contact is provided by the complementary connection region.

5. The drill pipe of claim 1, wherein the communication contacts are electrically isolated from each other, and wherein the complementary contacts are electrically isolated from each other.

6. The drill pipe of claim 1, wherein the communication connections are adapted to communicate at least one of a data signal, a control signal and a power signal.

7. The drill pipe of claim 1, wherein the first and third communication contacts provide for a first communication channel in a first direction along the drill pipe, and the second and third communication contacts provide for a second communication channel.

8. The drill pipe of claim 7, wherein the first communication channel and second communication channel are used for redundancy.

9. The drill pipe of claim 7, wherein the first communication channel and second communication channel are used for additional transmission capacity in the same direction.

10. The drill pipe of claim 7, wherein the first communication channel and second communication channel can alternate communication directions based on channel demands in each direction.

11. A drill pipe assembly useable in a wellbore, comprising:

a controller located at a surface of the wellbore; and a drill pipe disposed in the wellbore, the drill pipe comprising:

first, second, and third communication paths coupled to the controller, the communication paths isolated from one another;

a pin end connector having a body defined between external threads and an internal surface;

a box end connector to receive the pin end connector to connect sections of the drill pipe;

a first communication connector having a plurality of first communication contacts positioned at least partially within the body of the pin end connector; and a second communication connector having a plurality of second communication contacts positioned within the box end connector, wherein, when the drill pipe sections are connected by the box end connector and the pin end connector, the first communication contacts couple with the second communication contacts such that the first, second and third communication paths span between the drill pipe sections;

wherein the controller is adapted to select a pair of the at least first, second and third communication paths to provide a communication link along the length of the drill pipe;

wherein the controller selects the pair based on a failure of one of the at least first, second and third communication paths.

12. The drill pipe assembly of claim 11, wherein a first pair of the at least first, second and third communication paths provides a first communication link for communications received by the controller, and a second pair of the at least first, second and third communication paths provides a second communication link for communications transmitted from the controller.

13. The drill pipe assembly of claim 11, wherein the first communication connector comprises an insulative body to support the first communication contacts and electrically isolate the first communication contacts from each other and from the drill pipe, and wherein the second communication connector comprises an insulative body to support the second communication contacts and electrically isolate the second communication contacts from each other and from the drill pipe.

14. The drill pipe assembly of claim 13, wherein the drill pipe is made of an electrically conductive material, and wherein the first communication path is the drill pipe.

15. A method comprising:

connecting drill pipe sections together, comprising receiving a pin end connector with a box end connector, the pin end connector comprising a communication contact region having first, second and third communication contacts within a body of the pin end connector, the box end connector comprising a complementary communication contact region having first, second and third complementary communication contacts within a body of the box end connector;

communicating signals across first, second, and third isolated communication connections that span between the communication contact region and the complementary communication contact region;

using a controller to select a pair of the first, second and third communication connections to provide a communication link along the length of the drill pipe; and selecting the pair with the controller based on a failure of one of the first, second and third communication paths.

16. The method as recited in claim 15, wherein the pin end connector comprises a communication connector disposed in the communication contact region, wherein at least the first and second communication contacts are supported by the communication connector, and wherein the box end connector comprises a complementary communication connector disposed in the complementary contact region, wherein at least the first and second complementary communication contacts are supported by the complementary communication connector, and wherein the first and second communication connections are formed between the first and second communication contacts and the first and second complementary communication contacts.

17. The method as recited in claim 16, wherein connecting drill pipe sections comprise threadably engaging a connection region of the pin end connector with a complementary connection region of the box end connector, and wherein the third communication connection is formed by the threaded engagement of the connection region with the complementary connection region.

18. The method as recited in claim 16, wherein communicating comprises communicating signals in a first direction across the first communication connection and communicating signals in a second direction opposite the first direction.

19. The method as recited in claim 16, wherein the communication connector is disposed in a slot formed in a face of the longitudinal end of the pin end connector, and wherein the complementary connector is disposed in a slot formed in a face of an inner shoulder of the box end connector.

* * * * *